United States Patent [19]

Taylor

[11] 4,306,123

[45] Dec. 15, 1981

[54] CONTACT BLOCK

[76] Inventor: Glenn R. Taylor, 108 Duncan Cir., Beaver, Pa. 15009

[21] Appl. No.: 13,665

[22] Filed: Feb. 21, 1979

[51] Int. Cl.[3] ..... H01H 15/00

[52] U.S. Cl. ..... 200/16 A; 200/243; 200/250; 200/307; 200/280

[58] Field of Search ..... 200/16 A, 243, 250, 200/275, 307, 284, 280; 339/263 R

[56] References Cited

U.S. PATENT DOCUMENTS

| | | | |
|---|---|---|---|
| 2,623,087 | 12/1952 | Latta | 339/198 G |
| 3,238,341 | 3/1966 | Haydu | 200/16 A X |
| 3,253,092 | 5/1966 | Landow | 200/16 A |
| 3,437,773 | 4/1969 | Koertge | 200/280 |
| 4,064,381 | 12/1977 | Mullen et al. | 200/16 A |

OTHER PUBLICATIONS

C & K Components, Inc., Catalog No. 7702, pp. 23 and 24.

*Primary Examiner*—J. V. Truhe
*Assistant Examiner*—Morris Ginsburg
*Attorney, Agent, or Firm*—Webb, Burden, Robinson & Webb

[57] ABSTRACT

A contact block for an electrical switch includes an insulating housing for a pair of spaced stationary contacts. A movable contact support carrier or stroker carries a bridging member including contacts for engagement with the stationary contacts. Biasing means positioned between the stroker and the housing normally biases the carrier in the direction of a projection carried by the stroker, the stroker being actuated by a linear or rotary operator. Both normally open and normally closec contact blocks are described.

17 Claims, 14 Drawing Figures

CONTACT BLOCK

FIELD OF THE INVENTION

This invention relates to a contact block for an electrical switch and particularly to a contact block which is adapted to be actuated by a pushbutton linear or a rotary operator. The contact blocks may be normally open or normally closed. They may be used singly or in multiples.

BACKGROUND OF THE INVENTION

Heretofore, electric switches have been used in panels for controlling electrical apparatus. The switches usually were operated by a pushbutton linear or a rotary operator, also called a selector switch operator. The pushbutton or rotary operators used included means such as springs for biasing the pushbutton or rotary operator. Contact blocks carrying the stationary and movable electrical contacts and terminals were associated with the operators.

In prior contact blocks, however, assembly of the various elements was difficult and the connection between the contact blocks and the operator and other contact blocks in tandem was less facile than in the present invention.

Moreover, in prior contact blocks the same elements could not be used to make a normally open and normally closed switch.

SUMMARY OF THE INVENTION

A contact block for an electrical switch is adapted to be actuated by a pushbutton or rotary operator. The block includes a housing made of an insulating material, such as tough, flame-resistant Lexan, a polycarbonate manufactured and sold by General Electric Company and noted for its superior dielectric properties. A pair of spaced stationary contacts is positioned on contact supports in the housing. The contact supports are preferably made of heavy brass for corrosion resistance and good electrical conductivity. Contact buttons of fine silver are preferably riveted to the contact supports for low contact resistance. Angled terminals with captive saddle clamps are used to permit easy wiring.

A movable contact support carrier or stroker having a projection or operating extension extending from one side of the stroker through the housing is also disposed in the housing. A bridging member is reversibly mounted on said stroker and carries contacts for engagement with the stationary contacts. Means, such as a coil spring, are provided between the stroker and a wall of the housing for biasing the stroker in the direction of the projection. Preferably, a second biasing means or coil spring is provided between the stroker and the bridging member to permit some overtravel by the stroker upon engagement of the stationary and movable contacts.

On opposing ends of the contact block are two spaced arms, each of which includes an end flange for connecting the block to an operator or to another block. The ends of the block are tapered forming a recess into which the flanges of similar spaced arms of another block may be fitted.

The housing is closed by a cover, which is preferably transparent for ease of inspection of the operating elements and which forms one side of the recess on the end of the block. In the preferred form of the invention the housings are color-coded: a green housing identifies a contact block which is normally open and a red housing identifies a block which is normally closed.

Using the same elements, the contact block may be made normally open or normally closed simply by reversing the bridging member and its biasing spring so the movable contacts are on the proper side of the stationary contacts. The contact buttons may be reversed or two headed contact buttons may be used.

The stroker also includes an abutment on the side opposite the projection or operating extension for engagement with the projection on the stroker of a similar block connected thereto which may extend through an opening in the housing aligned with the abutment. The total length of the stroker is approximately equal to the height of the contact block.

The contact block according to the invention, in the preferred embodiment, is characterized by a novel symmetrical layout of the components of the housing on each side of the stationary contact supports in relation to the stroker and bridging member such that when the stroker is fully moved with the bridging member, it produces the same image as would be seen if the block were rotated 180° and the bridging member were positioned on the opposite side of the stationary contacts with the stroker in the unbiased position.

DETAILED DESCRIPTION OF THE INVENTION

Figure 1:
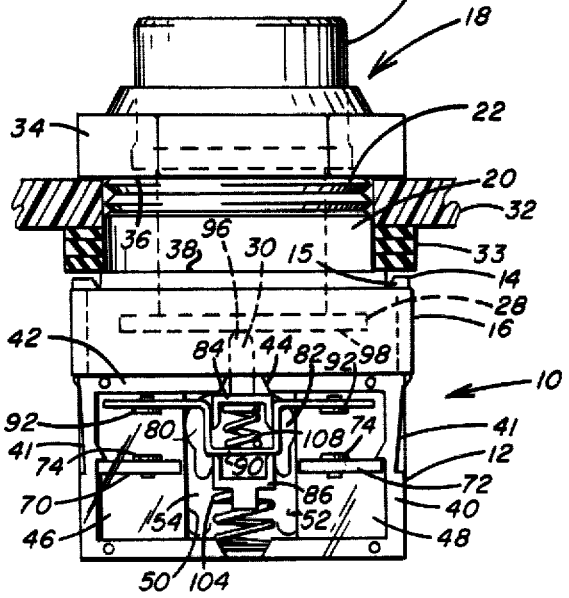
FIG. 1 is a top plan view of a normally open contact block in accordance with the invention connected to a linear operator.

Referring to FIG. 1, a normally open contact block 10 comprises a substantially rectangular housing 12 made of insulating material. The housing 12 includes two extending arms 14 for connection to the base 16 of an operator 18. The operator 18 may be a pushbutton linear or a rotary operator; preferably, the operator is one of those disclosed in my co-pending application Ser. No. 13,664, filed Feb. 21, 1979, entitled "PUSHBUTTON OPERATOR", now abandoned in favor of a continuing application Ser. No. 18,629, filed Aug. 25, 1980, the disclosure of which is incorporated herein by reference. For purposes of this application, the base 16 of the operator is preferably of rectangular cross section and has a hollow cylindrical extension 20. Threads 22 are provided at the end of the extension opposite the base. Disposed within the extension and the base is a pushbutton 24 connected to a stem 26 to which is connected a rectangular plate 28 which is adapted to contact a projection 30 of stroker 80 of the contact block to open and close the block electrically. The operator may be mounted in a control panel 32 by inserting the extension 20 with mounting gaskets 33 through an aperture in the panel and threading an internally threaded clamp ring 34 onto threads 22 until the panel 32 is secured tightly between lower surface 36 of the clamp ring and upper surface 38 of the base of the operator.

The housing 12 comprises opposed end walls 40 from which arms 14 having laterally extending flanges 15 extend in substantially parallel relationship to the end walls and perpendicular to a sidewall 42. The end walls of the block are tapered forming a recess 41 in each end wall into which the arms of a similar contact block may be fitted to provide multiple contact blocks. One side of each recess is defined by a mold line or side stop 43 molded in the housing; the opposite side of the recess is defined by an edge of a cover 110. In the sidewall 42 about midway between the arms and above the plane which cuts the side and end walls laterally is an opening 44 through which the projection 30 of the stroker extends. On opposite sides of the housing 12 adjacent the end walls are members 46, 48 which extend perpendicularly inwardly from the end walls substantially on this lateral plane. Each member terminates approximately one-third of the distance between the end walls in downwardly extending inside wall portions 50 which are joined by a laterally extending bottom wall 52 or bottom portion forming an inner channel 54 in the bottom of the housing 12.

The side of the housing opposite the sidewall 42 is partially closed by wall portions 56 above the lateral plane through the housing and by wall portion 58 which closes the end of the channel 54. The wall portions 56 and 58 define an opening 60 similar to opening 44 and exposed outer channels 62,64 within which electrical terminals 66,68 are located.

In the contact block according to the invention, there are two stationary contact supports 70, 72 on opposite sides of and within the housing 12. Each contact support carries a contact button 74, preferably of silver, and is integrally formed with a terminal 66, 68 which extends into the outer channels 62, 64. Each terminal 66, 68 includes a threaded opening for a conventional fastener 76 for connecting a conductor wire to the terminal. Preferably a captive saddle clamp 78 is provided on each fastener to facilitate wiring of an electrical conductor to the terminal.

Figure 7:
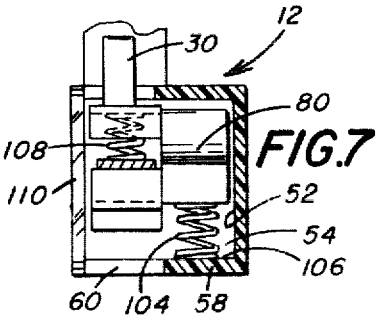
FIG. 7 is a sectional view of the contact block taken along lines VII—VII of FIG. 4.

The stroker 80 is preferably made of an internally lubricated material, such as a Teflon alloy which has high lubricity, minimal frictional resistance and good wear. The stroker is reciprocally located within the channel 54 formed in the bottom of the housing 12. The lower part of the stroker 80 is approximately the same height as the channel in which it is located (see FIG. 7) and includes smoothly rounded edges 82 to minimize frictional resistance as the stroker moves within the channel.

The upper part of the stroker 80 comprises two U-shaped members 84, 86 having the legs of the U-shapes spaced apart an equal distance. The outer edges of the legs of opposed members 84, 86 are also spaced apart to define a slot in which a metallic movable contact support or bridging member 88 is disposed. The width of the slot less the thickness of the bridging member is about equal to the amount of over-travel permitted. The bridging member is relatively elongated having a U-shaped central section 90 and two arms which extend outwardly therefrom. A contact button 92 is mounted on each arm in alignment with a contact button 74 on the stationary support member with which it will make electrical contact upon movement of the stroker. The open slot permits easy assembly of the bridging member on the stroker.

The projection 30 of the stroker extends from the outer surface 94 of U-shaped member 84 through opening 44 in the sidewall 42. Preferably, the outer end of the projection 30 is smoothly curved at 96 to reduce frictional contact with the bottom surface 98 of an operator plate, such as plate 28.

On the outer surface of the opposite U-shaped member 86 is an abutment 100. The total length of the stroker from the outer end of the projection to the surface of the abutment is approximately equal to the height of the housing, thus permitting stacking or ganging of multiple contact blocks. The abutment is aligned with opening 60 and is provided for contact with the projection of a second contact block, such as block 102 in FIG. 3, connected to contact block 103 whereby two contact blocks may be used in tandem operable by one operator.

A biasing means, such as coil spring 104, is disposed between the surface 106 of end wall 58 along the inner or bottom channel 54 and the stroker 80. In the normally open contact block shown in FIGS. 1–7, the spring 104 biases the support carrier in the direction of the projection 30, thus normally separating the contacts of the movable and stationary contact supports.

A second biasing means, such as small coil spring 108, is disposed in the space defined by the two arms of the U-shaped member 84 and the U-shaped central portion 90 of the bridging member. The purpose of the spring is to permit some overtravel of the stroker 80 when the bridging member 88 is moved to engage the movable and stationary electrical contacts. This assures electrical continuity through the contact block 10 in the mechanical operation of the block and takes into account wear on the components such as the contact buttons.

The top of the housing is closed by a cover 110 which prevents dust and other contaminants from entering the contact block. Preferably, the cover 110 is made of a transparent thermoplastic material which permits visual observation of the block components during manufacture, operation and for maintenance purposes. The edge of the cover also forms one side of the recess 41 for connection of another contact block thereto.

FIGS. 8–14 illustrate a second embodiment of the invention, namely a normally closed contact block 112. Since the elements of contact block 112 are the same as those used in the normally open contact block 10, the same reference numbers will be used to describe them.

The housing 12 of the contact block 112 is connected to an operator 18 which includes a pushbutton 24 to depress a plate 28. As in the first embodiment, the plate 28 is adapted to contact the projection 30 of a stroker 80 which is integrally formed with the stroker in the housing 12.

The only differences between the normally open contact block and the normally closed contact block are the assembly of the bridging member 88, the location of the biasing means 108 and the disposition of the contact buttons 74, 92. In the normally closed contact block, the bridging member 88 is reversed from that in the normally open contact block, that is the U-shaped central portion 90 of the bridging member 88 opens in a direction opposite the projection 30 and the outwardly extending arms of the bridging member are positioned on the side of the stationary contacts 70, 72 opposite to the projection 30. In the normally closed contact block, the biasing means or coil spring 104 in the inner channel 54 is also disposed between the inner surface of the wall 106 of the housing 12 and the side of the stroker 80 opposite the projection 30 such that the spring 104 tends to force the contacts on the bridging member 88 into mechanical engagement with the stationary contacts. To permit overtravel and assure good electrical continuity, a biasing means, coil spring 108, is disposed between the arms of U-shaped member 86 and the U-shaped central portion 90 of the bridging member.

To provide positive electrical continuity through the contact block, the contact buttons 74 and 92 in the normally closed contact block of FIGS. 8–14 are reversed from those in the normally open contact block of FIGS. 1–7 so that the heads of the buttons on the stationary and movable contact member are normally in engagement. Of course, two headed contact buttons may be used eliminating the need to reverse them.

To distinguish a normally open contact block from one which is normally closed, preferably the housings are molded of color-coded plastic material, i.e. green for normally open; red for normally closed. In all other respects the normally open contact blocks of the invention are the same, thus contributing to savings in materials, assembly, inventory, and their consequent expense.

Figure 3:
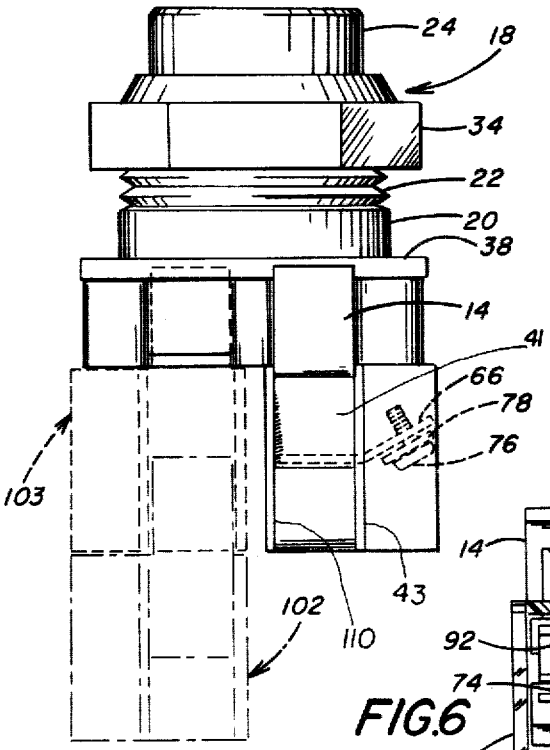
FIG. 3 is a side view of the contact block taken at 90° to the view shown in FIG. 1 and showing multiple contact blocks with a single operator.
Figure 4:
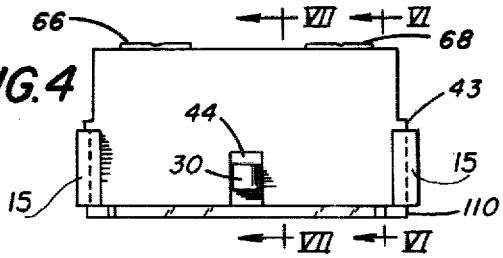
FIG. 4 is a rear elevational view of the contact block of FIG. 1 without an operator.
Figure 5:
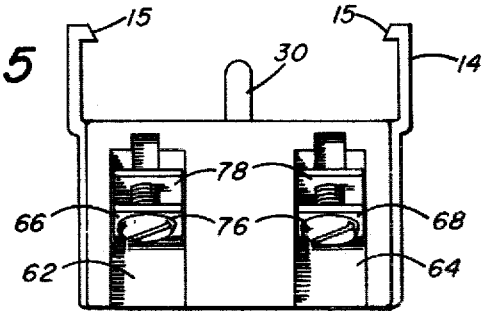
FIG. 5 is a bottom plan view of the contact block of FIG. 1 without an operator.
Figure 6:
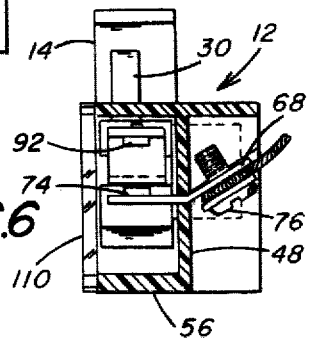
FIG. 6 is a sectional view of the contact block taken along lines VI—VI of FIG. 4.
Figure 10:
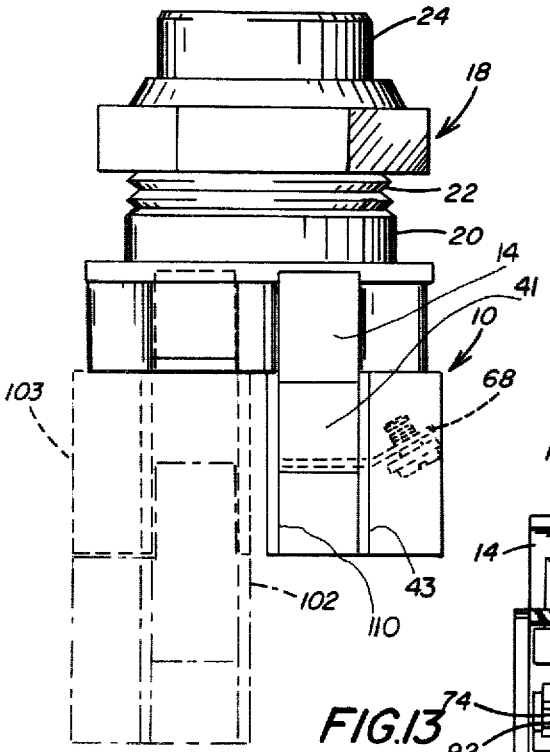
FIG. 10 is a side view of the contact block taken at 90° to the view shown in FIG. 8 and showing multiple contact blocks with a single operator.
Figure 11:
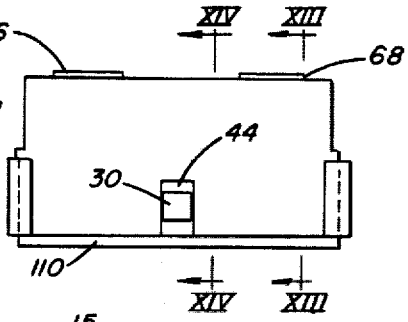
FIG. 11 is a rear elevational view of the contact block of FIG. 8 without an operator.
Figure 12:
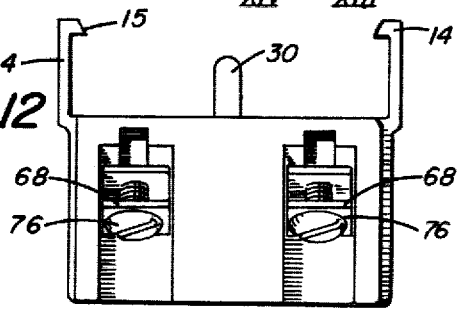
FIG. 12 is a bottom plan view of the contact block of FIG. 8 without an operator.
Figure 13:
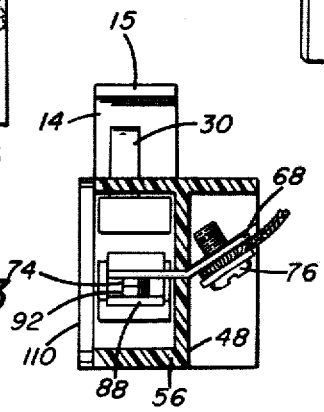
FIG. 13 is a sectional view of the contact block taken along lines XIII—XIII of FIG. 11.
Figure 14:
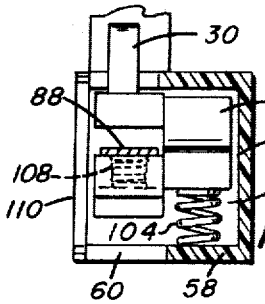
FIG. 14 is a sectional view of the contact block taken along lines XIV—XIV of FIG. 11.

FIGS. 3 and 10 of the drawings show that multiple contact blocks may be used in any combination with a single operator, whether the blocks are of the normally open or normally closed type. Hence, a single operator will efficiently open or close one or more switches to start or stop one or more independent pieces of electrical equipment. The number of contact blocks used with a single operator is usually limited to eight blocks, four blocks on each side of a single operator.

OPERATION

Figure 2:
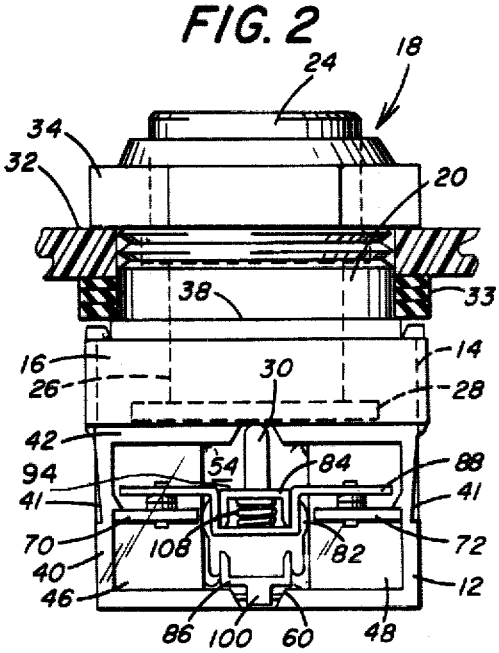
FIG. 2 is a top plan view of the contact block of FIG. 1 in the closed position.

The contact block, whether of the normally open or normally closed type, is connected to a pushbutton linear or rotary operator 18. If a linear operator is used, as shown in the drawings, with a normally open contact block 10, the contact block is as shown in FIG. 1. Full depression of the pushbutton, as shown in FIG. 2, will cause the operator to depress the projection 30, thus moving the stroker 80 in the inner channel 54 of the housing overcoming the force of spring 104 and carrying the bridging member 88 and the contact button 92 on the arms thereof into mechanical engagement and electrical contact with the contact button 74 on the stationary supports 70, 72. Release of the pushbutton 24 causes disengagement of the contacts under the force of the spring 104 as the stroker 80 with its projection 30 returns to the position illustrated in FIG. 1.

Figure 8:
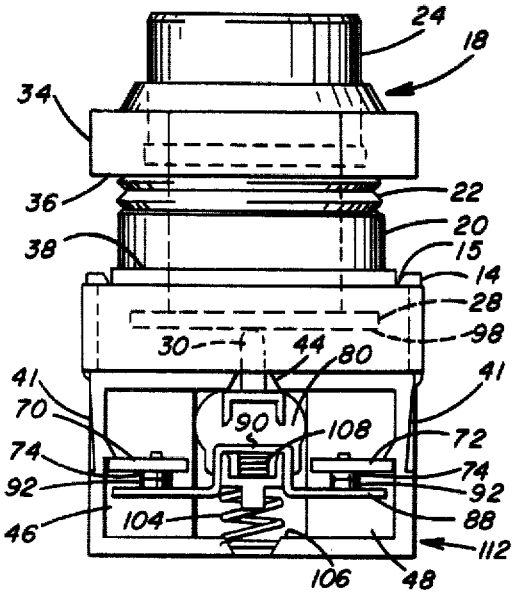
FIG. 8 is a top plan view of a normally closed contact block in accordance with the invention connected to a linear operator.
Figure 9:
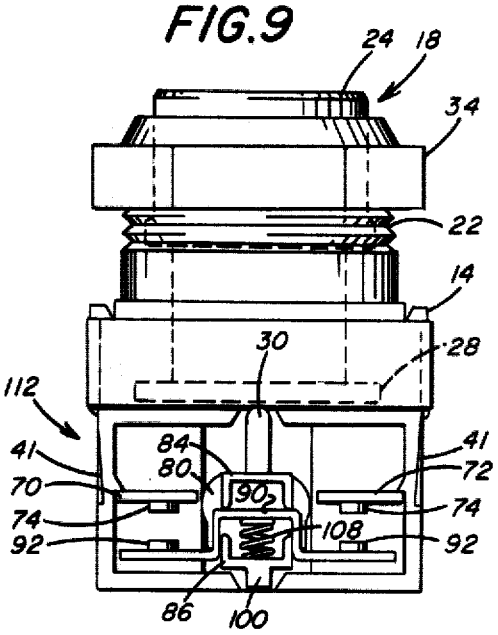
FIG. 9 is a top plan view of the contact block of FIG. 8 in the open position.

In the case of a normally closed contact block, the block 112 connected to a linear operator 18 as shown in FIG. 8 has the movable and stationary contacts 74, 92 in engagement under the force of spring 104 which biases the stroker 80 in the direction of the projection 30 and the operator 18. When the pushbutton 24 is fully depressed, as shown in FIG. 9, the projection 30 is forced in the direction of the spring 104 moving the stroker 80 in the direction opposite the projection carrying with it the bridging member 88, thus disengaging the contacts 74, 92 and opening the electrical circuit through the contact block 112.

Having described presently preferred embodiments of the invention it is to be understood that it may be otherwise embodied within the scope of the appended claims.

I claim:

1. A contact block for an electrical switch adapted to be actuated by a linear or rotary operator comprising:

A. an insulating housing;

B. a pair of spaced stationary contacts positioned in said housing;

C. a movable stroker disposed in a channel in the bottom of the housing including a pair of U-shaped members having legs opposed to but spaced from each other and having a projection extending from one side of the stroker through the housing to contact the operator;

D. a bridging member reversibly mounted on said stroker disposed in the space formed by said U-shaped members and having contacts for engagement with the stationary contacts, said bridging member including a U-shaped central portion;

E. means positioned between the stroker and a wall of the contact block for biasing the stroker in the direction of the projection whereby, in the case in which the bridging member is located on the same side of the stationary contacts as the projection, the switch is normally open, and in the case in which the bridging member is located on the opposite side of the stationary contacts from the projection, the switch is normally closed by the biasing means.

2. A contact block as set forth in claim 1 wherein the biasing means comprises a coil spring.

3. A contact block as set forth in claim 1 and including parallel arms extending from the housing for connection to an operator.

4. A contact block as set forth in claim 3 in which an end of each arm includes a flange for connection to a base of an operator.

5. A contact block as set forth in claim 3 wherein the housing includes a pair of sidewalls and the outside surfaces of the sidewalls include recesses for connection of arms of a similar contact block thereto.

6. A contact block as set forth in claim 5 and including a cover for the housing, the edges of said cover forming one side of each recess and a mold line forming the other side of each recess.

7. A contact block as set forth in claim 1 wherein the stationary contacts are mounted on stationary contact supports which are integrally formed with terminals to which an electrical conductor is adapted to be connected.

8. A contact block as set forth in claim 7 wherein the terminals include a threaded fastener having thereon a captive saddle clamp for tightening the conductor to the terminal.

9. A contact block as set forth in claim 1 and including a thermoplastic cover on the housing.

10. A contact block as set forth in claim 9 wherein the cover is made of transparent thermoplastic material.

11. A contact block as set forth in claim 1 wherein the insulating housing is made of a thermoplastic material of a first color in the case of a normally open contact block and of a second color in the case of a normally closed contact block.

12. A contact block as set forth in claim 11 wherein the first color is green and the second color is red.

13. A contact block as set forth in claim 1 and including second biasing means disposed between the central portion and the legs of one of the U-shaped members of the stroker to permit overtravel of the stroker with respect to the stationary contacts to assure good electrical continuity between the contacts on the bridging member and the stationary contacts upon engagement of said contacts.

14. An assembly comprising an operator having means for connection to at least one contact block and means for actuating the projection on a stroker of the contact block, said contact block comprising:

A. an insulating housing having a cover;

B. a pair of spaced stationary contacts positioned in said housing;

C. a movable stroker disposed in a channel in the bottom of the housing including a pair of U-shaped members having legs opposed to but spaced from each other and having a projection extending from one side of the stroker through the housing to contact the operator;

D. a bridging member reversibly mounted on said stroker disposed in the space formed by said U-shaped members and having contacts for engagement with the stationary contacts, said bridging member including a U-shaped central portion;

E. means positioned between the stroker and a wall of the contact block for biasing the stroker in the direction of the projection whereby, in the case in which the bridging member is located on the same side of the stationary contacts as the projection, the assembly provides a switch which is normally open, and in the case in which the bridging member is located on the opposite side of the stationary contacts from the projection, the assembly provides a switch which is normally closed by the biasing means.

15. An assembly as set forth in claim 14 and including at least two contact blocks connected to the operator such that the covers of said contact blocks are parallel to and adjacent to each other, said contact blocks being color-coded in that a normally open contact block housing is made of an insulating material of a first color and a normally closed contact block is made of an insulating material of a second color.

16. An assembly as set forth in claim 15 wherein said first color is green and said second color is red.

17. An assembly as set forth in claim 14 and including second biasing means disposed between the central portion and the legs of one of the U-shaped members of the stroker to permit overtravel of the stroker with respect to the stationary contacts to assure good electrical continuity between the contacts on the bridging member and the stationary contacts upon engagement of said contacts.

* * * * *